United States Patent [19]

Larker

[11] 4,209,420

[45] Jun. 24, 1980

[54] METHOD OF CONTAINING SPENT NUCLEAR FUEL OR HIGH-LEVEL NUCLEAR FUEL WASTE

[75] Inventor: Hans Larker, Robertsfors, Sweden

[73] Assignee: ASEA AB, Vasteras, Sweden

[21] Appl. No.: 860,557

[22] Filed: Dec. 14, 1977

[30] Foreign Application Priority Data

| | | | |
|---|---|---|---|
| Dec. 21, 1976 | [SE] | Sweden | 7614376 |
| Apr. 20, 1977 | [SE] | Sweden | 7704488 |
| Oct. 18, 1977 | [SE] | Sweden | 7711709 |

[51] Int. Cl.[2] ..... G21F 9/28

[52] U.S. Cl. ..... 252/301.1 W; 250/506; 250/507; 264/0.5; 264/60; 264/325; 264/332

[58] Field of Search ..... 252/301.1 W, 301.15; 264/0.5, 60, 325, 332; 250/506, 507; 75/208 R, 226; 422/159

[56] References Cited

U.S. PATENT DOCUMENTS

| | | | |
|---|---|---|---|
| 3,239,323 | 3/1966 | Folweiler | 264/332 |
| 3,356,496 | 12/1967 | Hailey | 75/226 |
| 3,499,066 | 3/1970 | Murray | 264/60 |
| 3,754,141 | 8/1973 | Leebl et al. | 250/507 |
| 3,992,202 | 11/1976 | Dulsi et al. | 75/226 |

FOREIGN PATENT DOCUMENTS

| | | | |
|---|---|---|---|
| 2145361 | 2/1973 | France | 250/507 |

*Primary Examiner*—Benjamin R. Padgett
*Assistant Examiner*—Deborah L. Kyle
*Attorney, Agent, or Firm*—Watson, Cole, Grindle & Watson

[57] ABSTRACT

A method of containing spent nuclear fuel or high-level nuclear fuel waste in a resistant material for isolating the fuel or the waste from the environment, includes the provision of an open container and a cover fitting the container opening, with both the container and cover being made of a ceramic material which is given a high density by isostatic hot pressing. The nuclear fuel or the waste is placed in the container, the cover is placed over the opening of the container, and the container with the cover is contained in a gas-tight casing, whereupon the opened container and the cover are joined by isostatic hot pressing into a homogeneous monolithic body within a completely closed space.

12 Claims, 6 Drawing Figures

METHOD OF CONTAINING SPENT NUCLEAR FUEL OR HIGH-LEVEL NUCLEAR FUEL WASTE

While nuclear fuel is being used, radioactive substances are formed which for a long period of time emit radiation which is harmful to living cells. It is therefore necessary to store spent nuclear fuel or high-level waste which is separated during the reprocessing of the fuel in such a way that the radioactive substances formed cannot spread into the environment and harmfully affect the biosphere. The predominant radioactive substances which are easily taken up by organisms and are therefore particularly dangerous are strontium-90 and cesium-137. These have relatively short half-lives and are thus dangerous for a limited period of time only. In the fuel rods there are further formed radioactive gases, plutonium, radioactive uranium isotopes and transuranic elements. The major part of these substances have a very long half-life and are thus dangerous for a very long period. For the final storage the aim is to achieve a safe enclosure of spent nuclear fuel or high-level nuclear fuel waste in such a way that the rods or the waste are protected from attack, for example from subsoil water containing corrosive and dissolving substances, which upon contact with the fuel rod or the waste may leach out any radioactive substances included therein and spread them to the nature.

The present invention relates to a method of containing spent nuclear fuel or high-level nuclear fuel waste hermetically in a ceramic capsule of a very resistant material, which isolates the contained fuel or waste from the surroundings for a long period of time. The capsule is therefore suitable for so-called final safe storage of the fuel or the waste. The produced capsules containing waste may be deposited in rock cavities. They may be stored freely in air in dry rock cavities and be cooled by the air, or they may be placed in cavities in the sides or on the floor of the rock and be embedded in clay which prevents or delays the scattering of radioactive material which may possibly leak out from the capsules. It is also possible to immerse the containers into great ocean depths. The water transformation at great ocean depths is very small and it takes a very long time before water from great ocean depths has moved to the upper surface of the ocean where the majority of the organisms of the ocean live. It takes such a long time before any leaking radioactive material reaches the upper ocean layers that the radiation will completely or partly cool. In addition, the dilution reduces the concentration.

According to the invention, an open container and a cover adapted to the container are manufactured from a resistant ceramic powdered material which is given high density and high strength by isostatic hot pressing. The nuclear fuel or the waste, usually enclosed in glass, is placed in the container. The cover is placed over the opening of the container. The container with its cover is enclosed in a gas-tight casing, for example a sheet metal capsule, and is inserted in a pressure furnace where the container and the cover are united into one monolithic, homogeneous body with a completely closed storage space by isostatic pressing at such a high temperature and such a high pressure that the materials in the ceramic container and the cover are joined together. It is important that the container and the cover have such a strength that only a limited reduction of diameter is obtained during this joining of the container and the cover into a closed ceramic capsule. It is desirable to maintain a free volume within the capsule where gaseous, active products formed in the fuel or the waste can be collected and retained. It is further desirable to avoid that the contained material is compressed or crushed. The storage space of the finished capsule may have a diameter of 200 mm or more and a length of 3000 mm or more. If the capsule is manufactured from a material which substantially consists of aluminum oxide, the pressing—both in the manufacture of the container and the cover and in the joining of these—is suitably performed at a temperature of 1300°-1400° C. and at a pressure of 0.5-2 kbar.

The container can be made with one single major storage space or with a plurality of small storage spaces, each one adapted to one or a few fuel rods or waste bodies. The container can be made with a cylinder, open at both ends, and with a detachable bottom. The end surfaces of the cover and the cylinder may be plane and ground to be well fitting. By applying a powder layer between the opposed surfaces of the container and the cover, a certain clearance between the surfaces can be tolerated. To prevent a radial compression of the cylinder at the joint during the hot pressing, the cover and the container can be provided with conical cooperating surfaces so as to obtain a certain support effect. Normally, however, it is more advantageous to apply a radial support body inside the container at the joint between the container and the cover. This support body is suitably made so that its coefficient of expansion is greater than the coefficient of expansion of the surrounding container wall. In this way it can be prevented that the shrinkage of the finished storage capsule becomes greater than the shrinkage of the support body which is not heated to the same temperture. A shrinkage is aimed at during the cooling so that a clearance is obtained between the wall of the finished capsule and the support body. If the cylinder and cover of the container are made of a material with a high content of aluminium oxide, $Al_2O_3$, the filling body may suitably be manufactured of a material with a high content of magnesium oxide, MgO. The filling body may be homogeneous but can also consist of a core of a ceramic material which is surrounded by a relatively thick metallic casing. In such a coherent filling body, the desired greater coefficient of expansion can be obtained even if the core consists of the same material as the walls of the container. The desired effect can be achieved if the thickness of the casing around the core consists of stainless steel with 18% chromium and 8% nickel. The thickness of the material should then suitably be 2.5% to 5% of the diameter of the filling body. For smaller containers and for containers with several storage spaces, it is possible to use plane covers. For larger containers with one single storage space, a dome-shaped cover is most practical. A cover shaped as half a spherical shell takes up an external overpressure in a favourable manner and can therefore be made relatively thin. The container can also be made as a bottle. The sealing can then be facilitated by a plug or a cap, but the filling of fuel rods or waste is made more difficult.

When sealing the capsule it is only necessary to heat the area around the cover and cylinder surfaces, which are to be joined together, to the sintering temperature. The heating of contained fuel or enclosed waste should be restricted. Upon sealing, the heating can therefore be concentrated to the upper part. The other part of the capsule is then only heated to the extent it is necessary for preventing the occurrence of detrimental stresses. The joining can be performed in a pressure chamber with a furnace space of limited height in the upper part of the chamber. However, there is nothing preventing the prepressing and the joining from being performed in the same furnace equipment. The lower part of the heater of the furnace can then, as a rule, only be utilized partially. To be able to utilize heating elements also in the lower part of a furnace, the lower part of the ceramic capsule can be provided with an outer insulation. It is also possible to protect the fuel or the waste in the capsule by embedding it in powdered insulating material.

The invention will be described in more detail with reference to the accompanying Figures.

Figure 1:
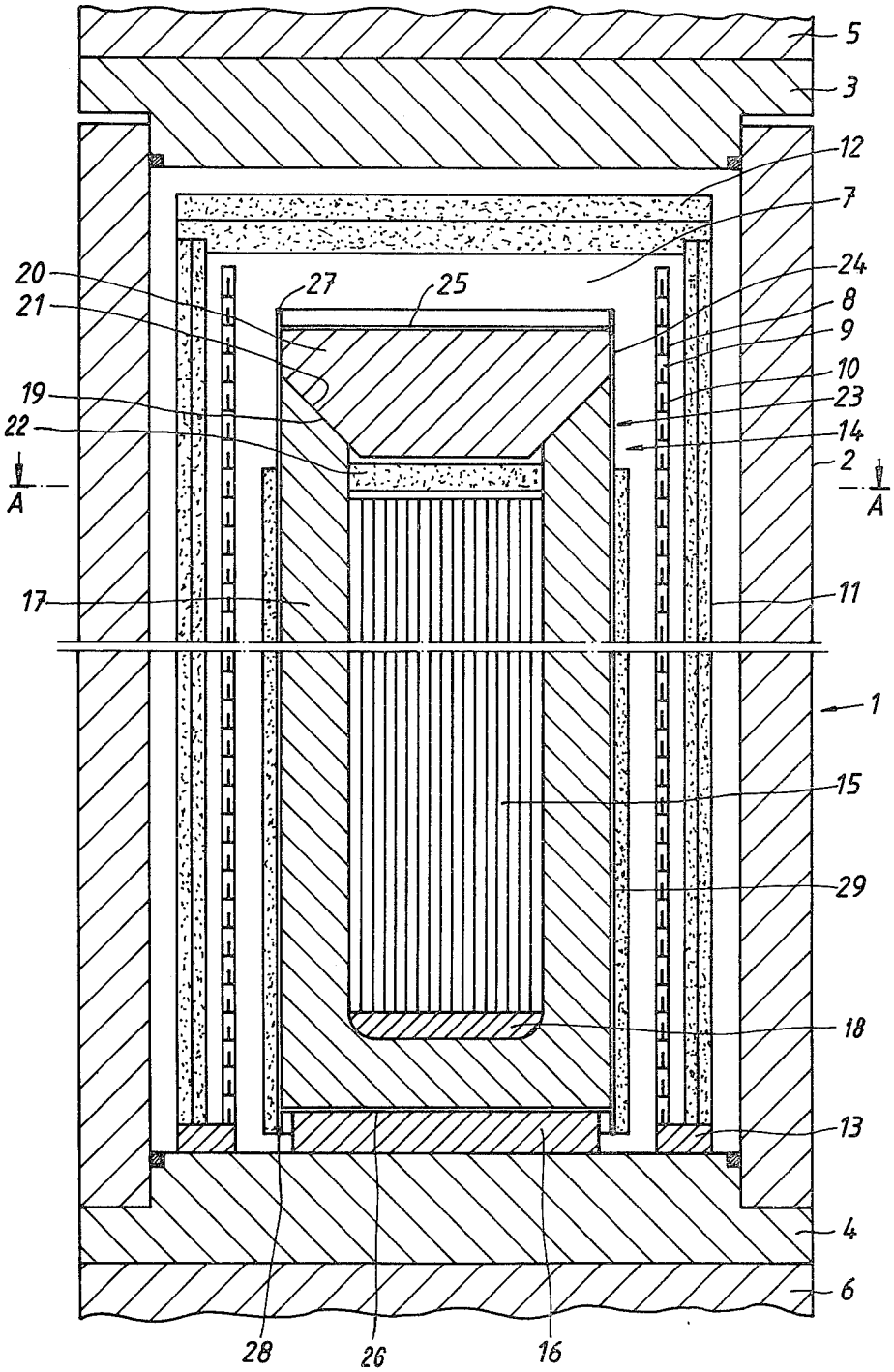
FIG. 1 shows a capsule for containment of spent nuclear fuel inserted in a pressure furnace for joining together the cover and the hollow cylinder by isostatic hot pressing, FIG. 2 a section through the capsule taken along A—A in FIG. 1, and FIG. 3 a capsule containing a number of nuclear waste cylinders arranged for connection of the cover and the hollow cylinder by isostatic hot pressing.

In the Figures, 1 designates a pressure chamber which is built up from a high-pressure cylinder 2 and end closures projecting into this, the cover 3 and the bottom 4, which under a pressing operation are held inserted into the cylinder by force-absorbing yokes 5 and 6 in a press stand, the rest of which is not shown. The pressure chamber contains a furnace space 7. Around the furnace space are a cylindrical heater 8 with annular channels 9 with heating elements 10 and a cylindrical insulating sheath 11 which is sealed by an insulating lid 12 at the top. The furnace space is thus thermically insulated from the walls of the pressure chamber 1 which take up the gas pressure and are thus subjected to considerable stresses. The heater 12 and the sheath 11 rest on a ring 13 which is gastightly joined to the bottom 4, thus preventing the circulation of gas.

A capsule 14 with fuel rods 15 is placed on an insulating plate 16 on the bottom 4. The capsule 14 contains a prepressed ceramic container 17, open at one end, in which rods 15 are placed on a filling plate 18. The wall of the container 17 forms a conical end surface 19 at the top. A lid 20 with a conical surface 21 is placed over the container 17. A layer 22 of insulating material is arranged above the rods 15. The ceramic container 17 with the lid 20 is surrounded by a gas-tight casing 23 consisting of a sheet metal cylinder 24 with a lid 25 and a bottom 26 which are gastightly connected by welds 27 and 28. The lower portion of the capsule 14 is surrounded by a layer of insulating material 29. Because of this layer of insulating material, the entire heater 8 can be used and the heating still be concentrated substantially to the upper portion of the storage cylinder, where the surfaces are joined through high pressure and high temperature so that the container 17 and the lid 20 will form a closed hollow case which safely insulates the fuel elements 17 from the surroundings. The lower portion of the capsule 14 neither need nor should be heated to the same extent as the portion around the lid 20. The fuel rods should not be heated to the temperature which is required for joining the lid and the cylinder.

Figure 2:
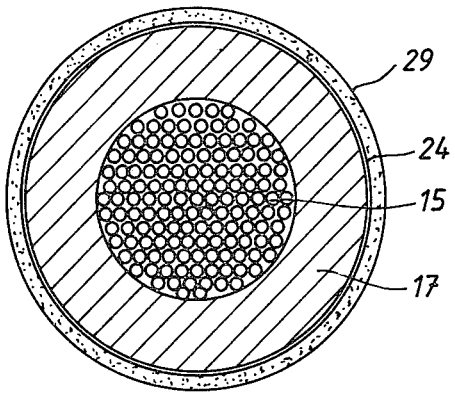
Figure 3:
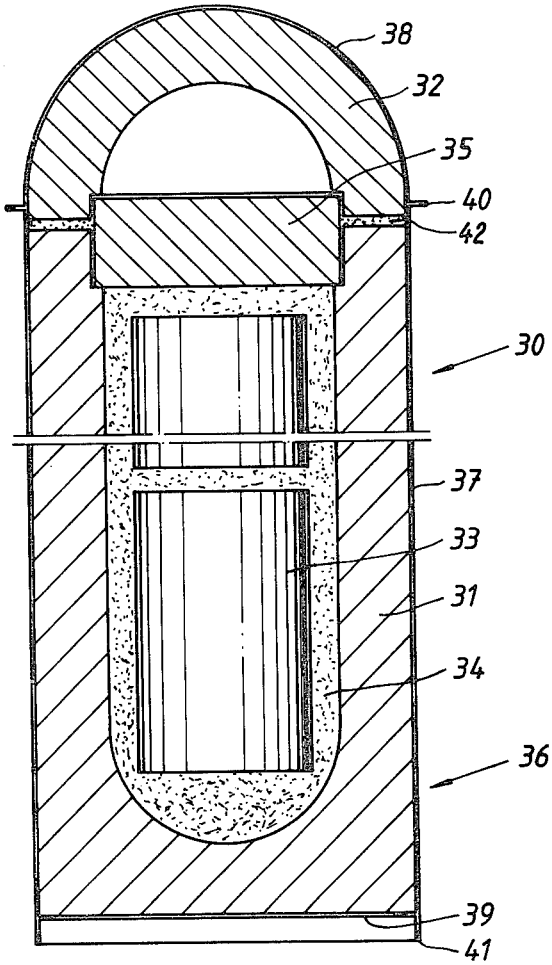

FIG. 3 shows a waste capsule 30 containing a cylindrical container 31 with a dome-shaped cover 32. A number of glass cylinders 33 containing waste are placed in the container 31. The glass cylinders are embedded in a powdered or grain-formed material 34 with a certain insulating ability so that the glass cylinders 33 will be heated to a lesser extent than the cylinder 31 without using an insulating layer 29 of the kind as shown in FIGS. 1 and 2. The upper portion of the container 32 comprises a support plate 35 which is intended to prevent radial compression of the upper portion of the container 31, since the shape of the cover does not provide any supporting function. In the gap between the container 31 and the cover 32 there is a powder layer 42 which, during the isostatic hot pressing, is sintered and bound together with the material is the containerr 31 and the cover 32 into a closed hollow case. The container with the cover is enclosed in the usual manner in a gas-tight sheet metal casing 36. This consists of a sheet metal cylinder 37 with a cover 38 and a bottom 39 which are joined by welds 40 and 41.

Figure 4:
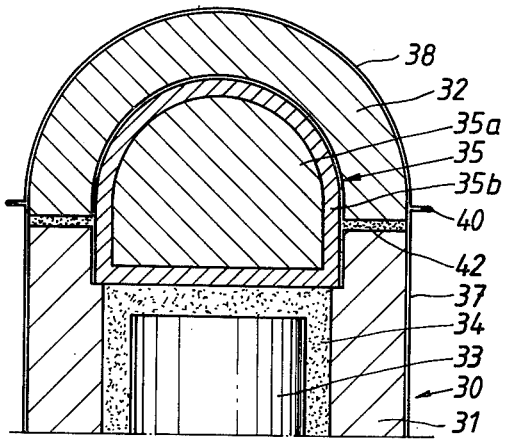
FIG. 4 shows an alternative embodiment of a support element.

FIG. 4 shows a variant of the waste capsule 30 with a composite support body 35 which is made of a core 35*a* of a ceramic material and a metallic casing 35*b*. In this variant the support body 35 also fills up the dome-shaped cover completely. The coefficient of expansion of this composite support body is, with a suitable dimensioning, greater than that of the container even if the same material is used in the core 35*a* as in the container 31 and in the cover 32.

Figure 5:
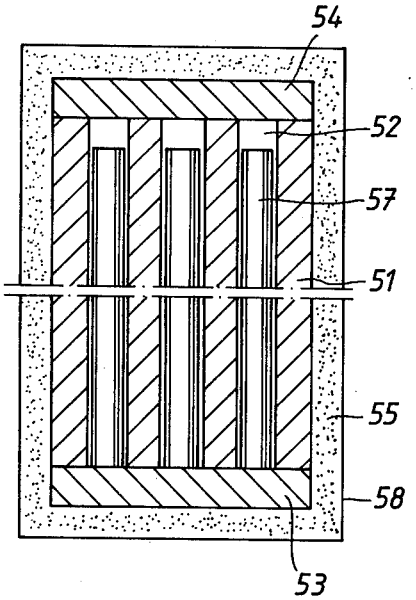
FIG. 5 and 6 show a capsule with a plurality of storage spaces for individual fuel rods or waste cylinders.
Figure 6:
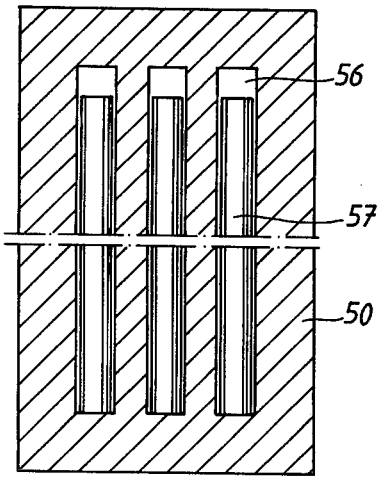

FIGS. 5 and 6 show a capsule 50 with a plurality of storage spaces. This capsule 50 is built up from a cylinder 51 with a number of through channels 52, a bottom 53, a cover 54 and a surrounding powder layer 55 which are joined through isostatic hot pressing into a homogeneous monolithic unit with closed storage spaces 56 for a number of cylinders or fuel rods 57. The cylinder, the cover, the bottom and the powder are contained in a gas-tight metal casing 58 during the pressing.

I claim:

1. A method of isolating spent nuclear fuel or high-level nuclear fuel waste from the environment for an extended period of time, comprising the steps of forming an open container and a cover fitting the open end of the container from a ceramic powder material, compacting said container and said cover into bodies having a high density and strength by hot isostatic pressing, inserting spent nuclear fuel or high-level waste into said open container, placing said cover over said open end of said container, enclosing said open container and said cover in a gas-tight metal casing, joining said open container and said cover together by hot isostatic pressing into a homogeneous monolithic body so that the fuel or waste is enclosed within a completely closed space, and disposing said casing and said container in a final storage location.

2. The method according to claim 1, wherein said container and said cover are formed from $Al_2O_3$.

3. The method according to claim 1, wherein said compacting step is carried out at a pressure of 0.5 to 2.0 kbar at a temperature of 1300° to 1400° C.

4. The method according to claim 1, wherein said joining step is carried out at a pressure of 0.5 to 2.0 kbar at a temperature of 1300° to 1400° C.

5. The method according to claim 1, wherein said container is formed with a single storage space for containing a plurality of fuel rods or waste bodies.

6. The method according to claim 1, wherein said container is formed with a plurality of storage spaces adapted to contain at least one fuel rod or waste body.

7. The method according to claim 1, wherein said container is formed as a cylinder having a detachable bottom.

8. The method according to claim 1, wherein said joining step includes heating said container and said cover to a substantially sintering temperature limited to the area around the joint between said container and said cover.

9. The method according to claim 8, wherein insulating material partially surrounds said container.

10. The method according to claim 1, wherein a support body is mounted in said container at the joint between said container and said cover.

11. The method according to claim 10, wherein the coefficient of expansion of said support body is greater than that of said container and said cover.

12. The method according to claim 1, wherein the compacted container and cover are mounted in a sheet metal capsule and between the opposed surfaces of the container and cover is provided by a powder layer which is joined to said container and cover during the hot pressing thereof.

* * * * *